US005887665A

United States Patent [19]

Seifert et al.

[11] Patent Number: 5,887,665

[45] Date of Patent: Mar. 30, 1999

[54] STRIKING ELEMENT

[75] Inventors: Hans-Carsten Seifert, Basel; Peter Delfosse, Liestal, both of Switzerland

[73] Assignee: Synthes (U.S.A.), Paoli, Pa.

[21] Appl. No.: 633,781

[22] PCT Filed: Aug. 19, 1994

[86] PCT No.: PCT/EP94/02758

§ 371 Date: Aug. 19, 1996

§ 102(e) Date: Aug. 19, 1996

[87] PCT Pub. No.: WO96/05944

PCT Pub. Date: Feb. 29, 1996

[51] Int. Cl.[6] ..... B25D 17/06

[52] U.S. Cl. ..... 173/91; 173/17; 173/135; 173/210; 173/206

[58] Field of Search ..... 173/91, 125, 127, 173/128, 131, 132, 206, 207, 210, 13, 17, 19, 212, 135

[56] References Cited

U.S. PATENT DOCUMENTS

| | | | |
|---|---|---|---|
| 891,472 | 6/1908 | Fowler | 173/128 |
| 2,210,020 | 8/1940 | Anderson | 173/127 |
| 2,787,123 | 4/1957 | Delvaux | 173/127 |
| 3,425,499 | 2/1969 | Fisher | 173/125 |
| 3,583,499 | 6/1971 | Cordes | 173/132 |
| 4,825,960 | 5/1989 | Krone | 173/207 |
| 5,152,352 | 10/1992 | Mandanis | 173/91 |
| 5,485,887 | 1/1996 | Mandanis | 173/91 |

FOREIGN PATENT DOCUMENTS

| | | |
|---|---|---|
| 49255 | 10/1889 | Germany . |

*Primary Examiner*—Scott A. Smith
*Attorney, Agent, or Firm*—Fish & Richardson P.C.

[57] ABSTRACT

The striking element (1) according to the invention serves for the production of shocks which act on a tool. It has a body (3) with a plurality of parallel bores (4). A piston (2), heavy in mass, runs pressure-tight in each of these bores (4) and strikes stops which may be mounted without or within the piston (2). An end space (9) lies at each of the faces of the piston (2). The pistons (2) serve to control the function of the striking element (1). At least one of the pistons (2) produces shocks on the tool. The striking element may execute working shocks in the direction of the tool and, in a special embodiment, execute loosening shocks in the opposite direction. In a special embodiment the magnitude of the energy of loosening shocks may be adjusted or suppressed.

The striking element is employed principally in surgery, but also in the general manufacture of apparatus.

26 Claims, 7 Drawing Sheets

STRIKING ELEMENT

BACKGROUND OF THE INVENTION

The invention relates generally to striking elements for producing mechanical shocks transmitted to a tool.

Striking elements are well known as parts of an impact tool. They produce shocks and transmit them to the tool belonging to the impact tool. Mention may be made here, for example, of percussion drills, wherein an unbalanced mass connected to the drill drive acts as the striking element which, when the drill is operated as a tool, additionally allows it to execute axial shocks.

A striking element used chiefly in surgery is described in EP 0,452,543 A1. There a single piston, displaceable in a cylinder by compressed air, does the work. On a forward stroke—directed against a tool connected to the striking element—this piston acts on a first impact surface, and this shock is transmitted to the tool. On its subsequent return stroke the piston acts on a second impact surface. The tool—a rasp, for example, is mentioned there —is successively exposed to a forward-thrust working shock and an opposing loosening shock. At least one high-pressure channel between the first and the second impact surfaces is present in the striking element, by which the pressure necessary for motion of the piston is built up during the motion cycle. In addition, at least one inlet and one outlet are provided for compressed air.

For the construction of this striking element, a total volume consisting of a first partial volume, which lies between the first impact surface and the piston area belonging to it, and the volume of the high-pressure channel is determined at particular positions of the piston. The necessary pressure may be built up and the striking element functions only when the ratio of the value of this total volume to the area of the active first impact surface and of the second impact surface exceeds predetermined values. Embodiments are indicated by which the loosening shock may in each instance be suppressed either permanently or at times.

The striking element according to EP 0,452,543 has a relatively complicated mechanical structure. For example, it has two different diameters for the cylindrical bore and the piston diameter, a column running within the piston and a total of six impact surfaces requiring machining. Compared to the overall arrangement of the striking element, the piston itself has only a small mass. Since the pressure in the volume between the respective impact plate and the associated piston area is built up or let down only during its motion, the piston motions proceed relatively slowly, so that the energy transmitted to the tool by the piston motions per unit of time is relatively small.

Therefore an object of the invention is to procure a striking element which, with external dimensions comparable to those of the striking element described above, achieves a higher striking rate and transmits a greater amount of energy to the tool per shock.

SUMMARY OF THE INVENTION

This object is accomplished in the striking element according to the invention by the features of the characterizing portion of claim 1. The other claims characterize advantageous embodiments.

BRIEF DESCRIPTION OF THE DRAWINGS

The invention is explained with the aid of the drawing, wherein.

Figure 1:
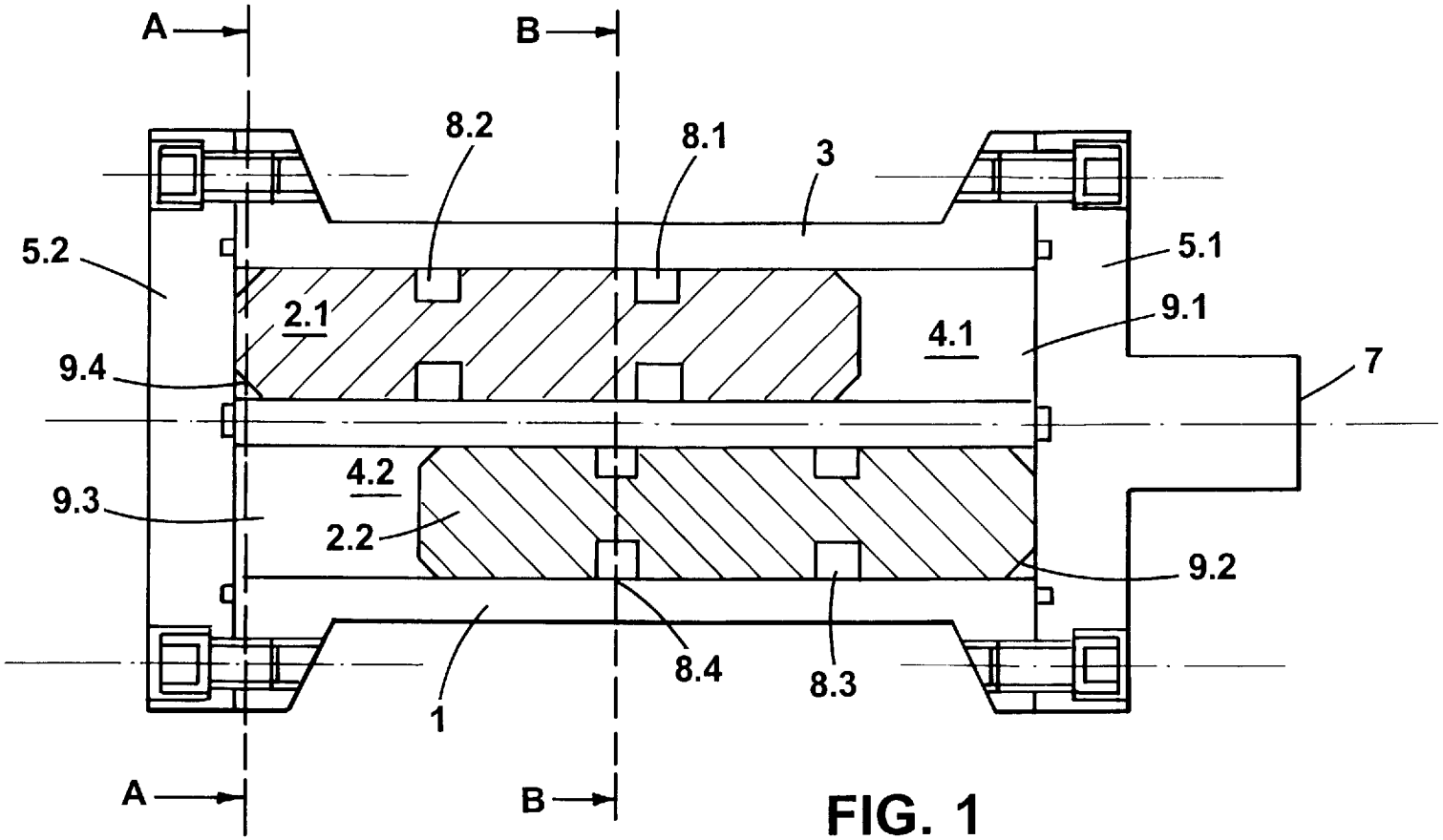
FIG. 1 shows a first example of a striking element having two pistons in a longitudinal section, FIG. 2, the striking element of FIG. 1 in a cross section A—A, FIG. 3, the striking element of FIG. 1 in a cross section B—B.
Figure 3:
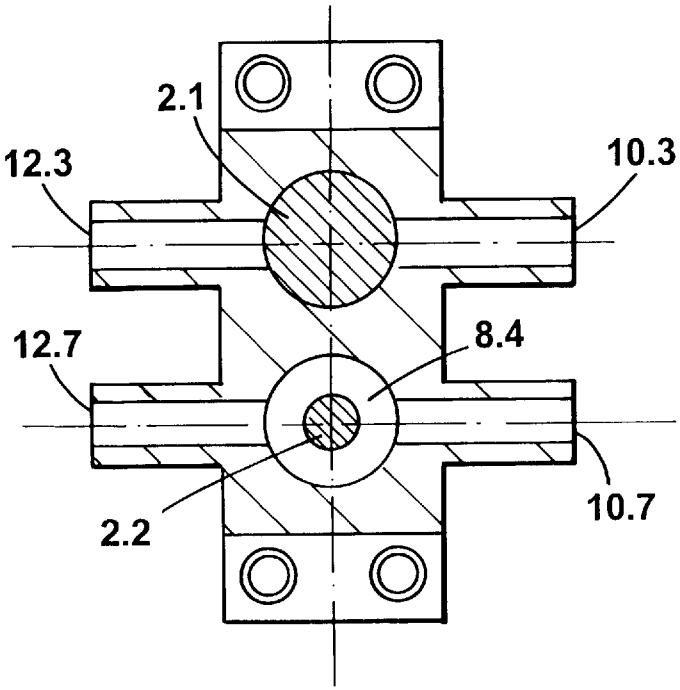
Figure 2:
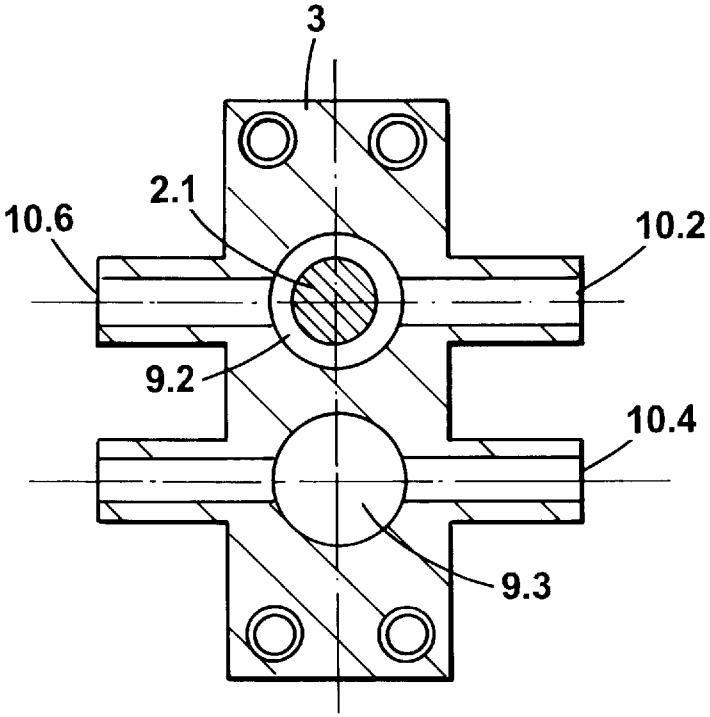
Figure 4:
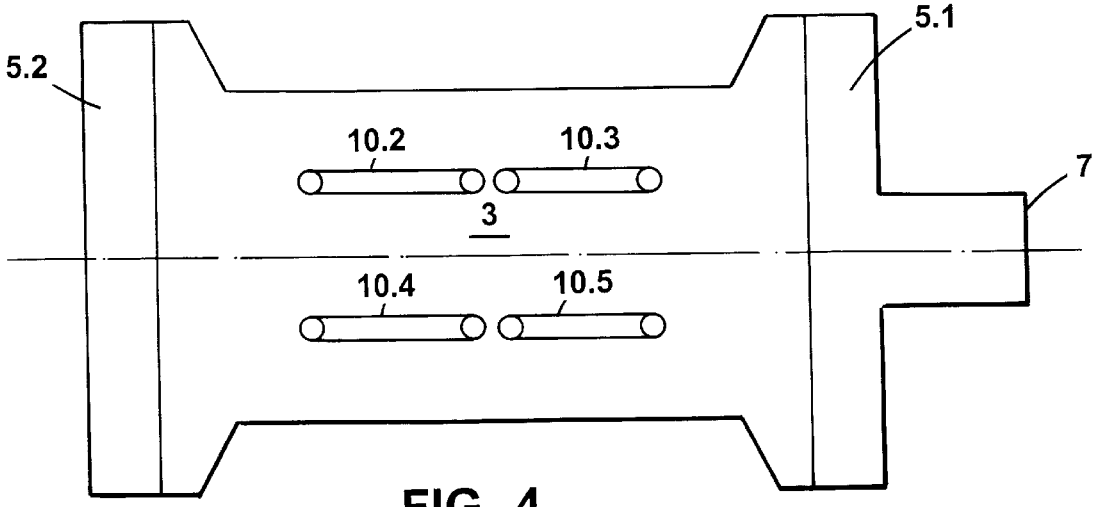
FIG. 4 shows the striking element of FIG. 1 in a side view.

Where different parts of the same type are described in a figure of the drawing, in each instance a subordinate reference numeral, separated by a period for identification of the various parts, is assigned to the reference numeral identifying the said part.

DESCRIPTION OF THE PREFERRED EMBODIMENTS

A first example of a striking element 1 according to the invention is represented in FIGS. 1 to 4. It has two pistons 2, a first piston 2.1 and a second piston 2.2. The striking element 1 has a body 3, which here is designed in the shape of a longitudinal prism. However, the body 3 may alternatively be shaped another way. A first bore 4.1 and a second bore 4.2 pass parallel through the body 3. The bores 4 lie in the direction of the major axis—here from left to right—of the body 3. The first piston 2.1 travels in the first bore 4.1, the second piston 2.2 in the second bore 4.2. The right-hand face of the body 3 is closed off by a first stop (5.1), here a first impact plate 5.1, the left-hand face by a second stop (5.2), here a second impact plate 5.2, both lying transverse to the axes of the bores 4. (In describing the first example, we shall use "impact plate," the appropriate term here, and, in a second example and in the claims, the more generally applicable term "stop"). The pistons 2 travel gas-tight in their associated bores 4 and are individually capable of exerting shocks on the impact plates 5. Gas-tightness between the body 3 and the impact plates 5 is produced, for example, by seals 6, and that between the body 3 and the pistons 2, for example, by lubrication. To one—here the second—impact plate 5.2 there is attached a nipple 7 (called "shank" 7 in the second example and in the claims), which here bears a thread, and to which a tool not shown here, for example, a rasp, a saw or a drill, may be fastened—usually by means of a snap closure or a drill chuck—and to which the shocks of the striking element 1 are transmitted. However, other types of fastening for replaceable tools may alternatively be provided.

The pistons 2 have indents 8, in the form of milled grooves or recesses, at predetermined locations on their surfaces, here annular indents 8 in the form of a first recess 8.1 on the right and a second recess 8.2 on the left on the first piston 2.1, as well as a third recess 8.3 on the right and a fourth recess 8.4 on the left on the second piston 2.2. However, these indents 8 may alternatively be formed another way, for example, as longitudinal milled grooves running over short regions in the axial direction of the bores 4. The pistons 2 then must have, for example, a cross section that is nonrotatable in respect to the body 3.

In addition, between the first piston 2.1 and the first impact plate 5.1 there is in each instance a first end space 9.1, between the first piston 2.1 and the second impact plate 5.2, a second end space 9.2, between the second piston 2.2 and the first impact plate 5.1, a third end space 9.3, and between the second piston 2.2 and the second impact plate 5.1, a fourth end space 9.4. The pistons 2 and/or the impact plates 5 preferably are shaped in such fashion that the piston 2 cannot contact the impact plate 5 over its entire face, so that an end space 9 always remains, even during the shock of a piston 2 against an impact plate 5.

Figure 8:
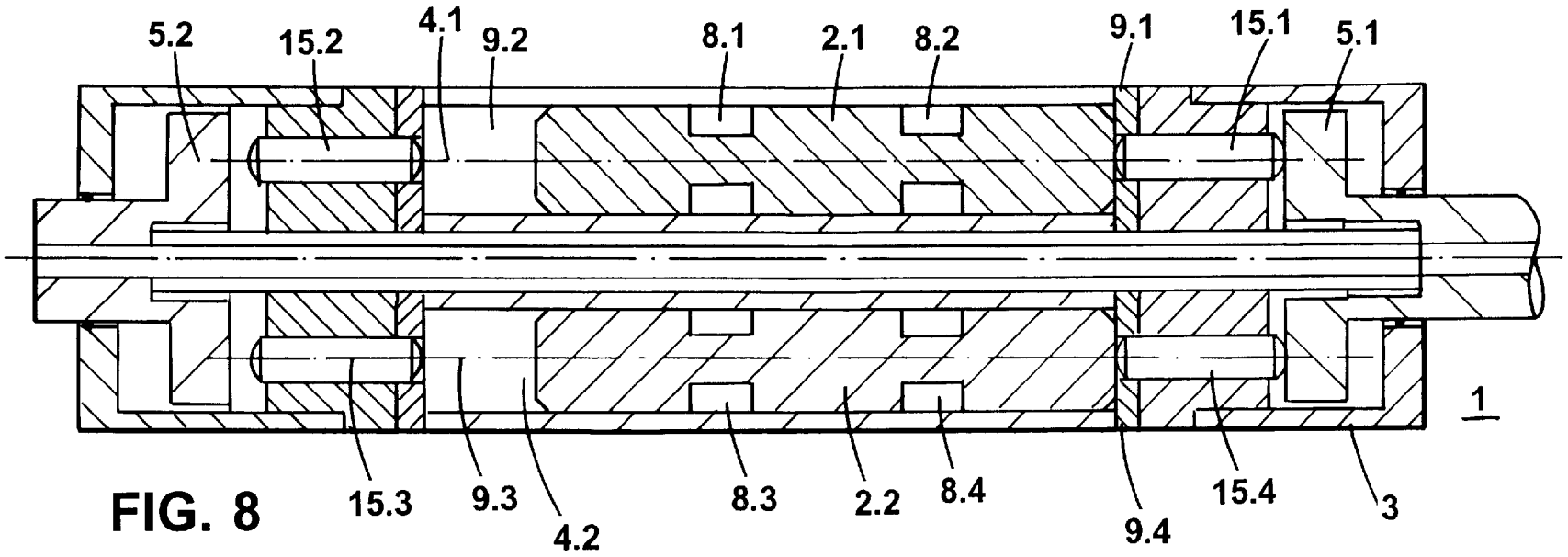
FIG. 8 shows a striking element similar to that of FIG. 1 wherein shocks are transmitted through the intermediacy of impact pins.

Transmission of the shock of the pistons 2.1 and 2.2 to the impact plates 5.1 and 5.2, however, may alternatively be effected in another way, so a striking element wherein transmission of shocks takes place by means of four striking pins 15.1 to 15.4 is shown in FIG. 8. The other parts correspond to those in the preceding figures and are designated by the same subordinate numerals.

Figure 6:
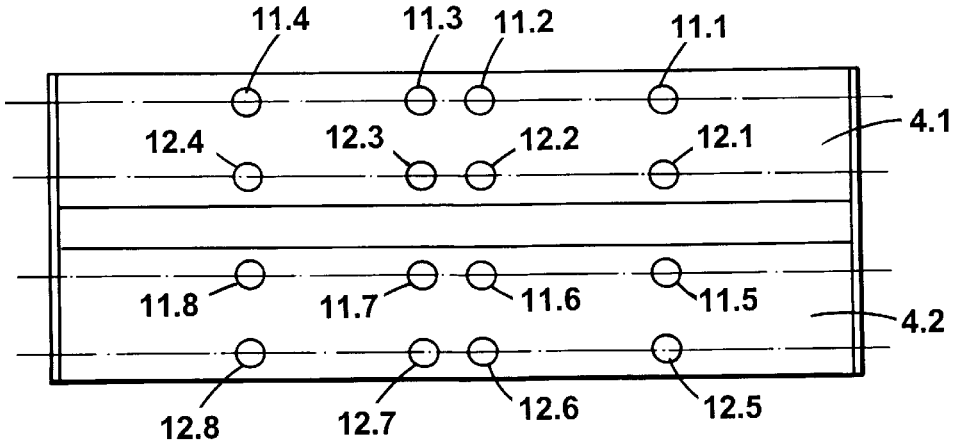
FIG. 6 shows the location of openings of the pressure lines and pressure supply lines within the bores in an impact element of FIG. 1.

The indents 8 and the end spaces 9, together with the pressure lines 10, beginning with pressure line openings 11 at the outer walls of the bores 4 and here ending at the inner sides of the impact plates 5, with pressure supply lines 12 and a pneumatic or hydraulic pressure medium, serve for controlling the striking element 1. However, the pressure lines 10 alternatively may end at the front ends of the outer walls of the bores 4. The diagram of the method of operation of this control system is shown in FIG. 5 by subfigures 5A to 5D. The pressure line ends 11.1 to 11.8 and the pressure supply lines 12.1 to 12.8 on the surfaces of the bores 4.1 and 4.2 are indicated by way of example in FIG. 6. For reasons of space, these are not shown in the subfigures 5A to 5D, but their locations may easily be discerned by observation of FIG. 5 and FIG. 6. In addition, the end spaces 9, to which a high pressure is applied, are represented shaded, the vented end spaces being left unshaded.

Figure 5A:
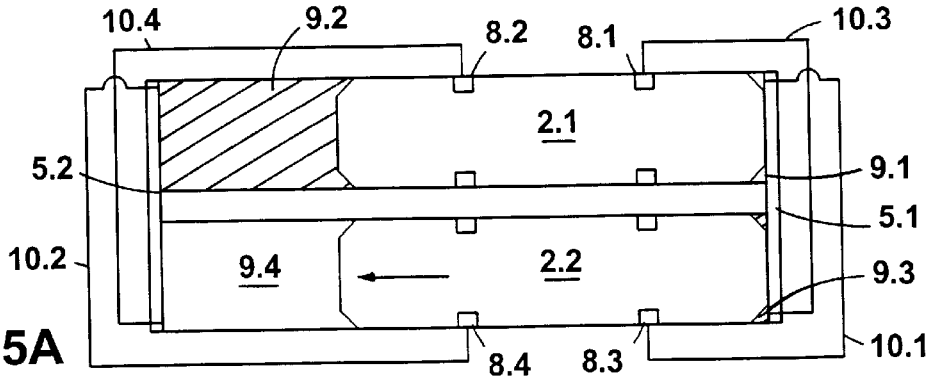
FIG. 5 shows a simplified diagram of the method of operation of the striking element of FIG. 1.

In FIG. 5A both pistons 2.1 and 2.2 rest against the impact plate 5.2 on the right. The first end space 9.1, on the right-hand side of the first piston 2.1, is connected by a first pressure line 10.1 with the location of the third recess 8.3 on the second piston 2.2 and ends there at the fifth pressure line opening 11.5. The third recess 8.3 is vented through a fifth pressure supply line 12.5. At this time the first end space 9.1 is also vented by the pressure line 10.1, no pressure acting there on the piston 2.1.

The second end space 9.2, on the left-hand side of the first piston 2.1, is connected by a second pressure line 10.2 with the location of the fourth recess 8.4 on the second piston 2.2 and ends there at the seventh pressure line opening 11.7. The fourth recess 8.4 is placed under high pressure (for example, 6 bar) by a pressure supply line 12.7. At this time the second end space 9.2 is also placed under high pressure by the pressure line 10.2. If the second end space 9.2 is under high pressure and the first end space vented, the piston 2.1 is pressed against the impact plate 5.1 and does not move.

The third end space 9.3, on the right-hand side of the second piston 2.2, is connected by a third pressure line 10.3 with the location of the first recess 8.1 on the first piston 2.1 and ends there at the first pressure line opening 11.1. The first recess 8.1 is placed under high pressure by a first pressure supply line 12.1. At this time the third end space 9.3 is also placed under high pressure by the third pressure line 10.3.

The fourth end space 9.4, on the left-hand side of the second piston 2.2, is connected by a fourth pressure line 10.4 with the location of the second recess 8.2 on the first piston 2.1 and ends there at the third pressure line opening 11.3. The second recess 8.2 is vented through a third pressure supply line 12.3. At this time the fourth end space 9.4 is also vented through the pressure line 10.4.

If the third end space 9.3 is under high pressure and the fourth end space 9.4 vented, the second piston 2.2, as indicated by the arrow drawn in it, is displaced toward the left. The recesses 8 are located so that the associated pressure line opening 11 and the pressure supply line 12, for example in the direction of the periphery, are even with one another. The pressure difference displacing the second piston 2.2 is maintained by this arrangement until the piston 2.2 hits the impact plate 5.2. Thus the position of FIG. 5B is reached.

Figure 5B:
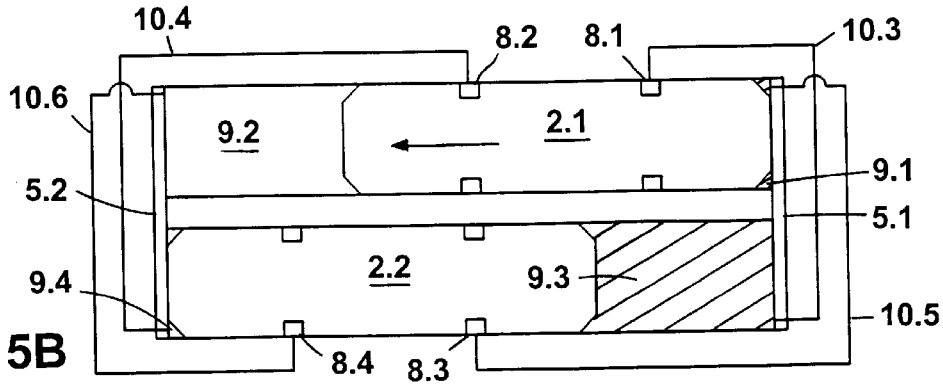

In FIG. 5B the first end space 9.1 at the first piston 2.1 is connected by a fifth pressure line 10.5 with the now altered location of the third recess 8.3 on the second piston and ends there at the sixth pressure line opening 11.6. The third recess 8.3 is placed under high pressure by a sixth pressure supply line 12.6. At this time the first end space 9.1 is also placed under high pressure by the fifth pressure line 10.5.

The second end space 9.2 at the first piston 2.1 is connected by a sixth pressure line 10.6 with the now altered location of the fourth recess 8.4 on the second piston 2.2 and ends there at the eighth pressure line opening 11.8. The fourth recess 8.4 is vented through a pressure supply line 12.8. At this time the second end space 9.2 is also vented through the sixth pressure line 10.6.

If the first end space 9.1 is under high pressure and the second end space 9.2 vented, the piston 2.1 is moved toward the impact plate 5.2 and hits the impact plate 5.2. During this period, the piston 2.2 does not move. Thus the position of FIG. 5C is reached.

Figure 5C:
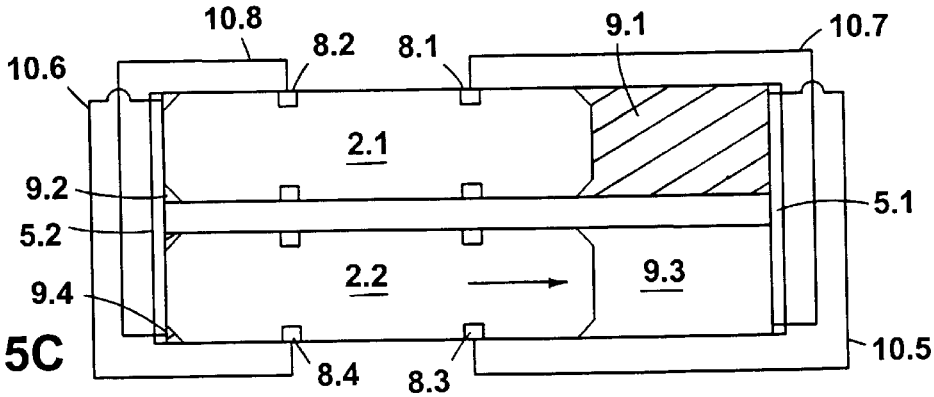

In FIG. 5C the third end space 9.3 at the second piston 2.2 is connected by a seventh pressure line 10.7 with the now altered location of the first recess 8.1 on the first piston 2.1 and ends there at the second pressure line opening 11.2. The first recess 8.1 is vented through a second pressure supply line 12.2. At this time the third end space 9.3 is also vented through the seventh pressure line 10.7.

The fourth end space 9.4 at the second piston 2.2 is connected by an eighth pressure line 10.8 with the now altered location of the second recess 8.2 on the first piston 2.1 and ends there at the fourth pressure line opening 11.4. The second recess 8.2 is placed under high pressure by a pressure supply line 12.4. At this time the fourth end space 9.4 is also placed under high pressure through the fourth pressure line 10.4.

If the fourth end space 9.4 is under high pressure and the third end space 9.3 vented, the piston 2.2 is moved against the impact plate 5.1 and hits it. During this time the piston 2.1 does not move. Thus the position of FIG. 5D is reached.

Figure 5D:
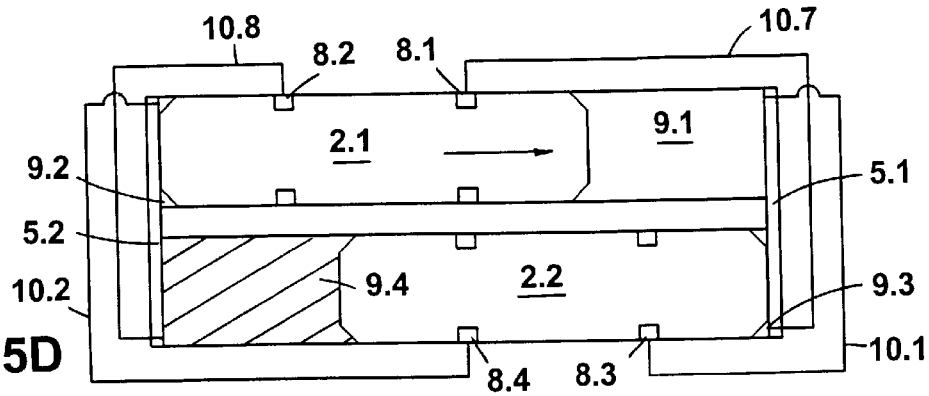

In FIG. 5D the first end space 9.1 at the first piston 2.1 is connected by a first pressure line 10.1 with the now altered location of the third recess 8.3 on the second piston 2.2 and ends there at the fifth pressure line opening 11.5. The third recess 8.3 is vented by a fifth pressure supply line 12.5. At this time the first end space 9.1 is also vented through the first pressure line 10.1.

The second end space 9.2 at the first piston 2.1 is connected by a second pressure line 10.2 with the now altered location of the fourth recess 8.4 on the second piston 2.2 and ends there at the seventh pressure line opening 11.7. The fourth recess 8.4 is placed under high pressure by a seventh pressure supply line 12.7. At this time the second end space 9.2 is also placed under high pressure through the second pressure line 10.2.

If the second end space 9.2 is under high pressure and the first end space 9.3 vented, the first piston 2.1 is moved toward the impact plate 5.1 and hits it. During this time the piston 2.2 does not move. Thus the position of FIG. 5A is reached anew.

The cycle of FIG. 5A to FIG. 5D and back again to Fig. 5A is continued until the supply of high pressure is interrupted. During this whole time, double shocks are continuously administered to the impact plate 5.1, which shocks are transmitted to the tool connected to it and which in each instance are followed by a double loosening shock against the impact plate 5.2.

The essence of a striking element according to the invention which has a number higher than two pistons 2 will be described by means of the following example. Such a striking element consists of a body 3 having a plurality of parallel bores 4, which are closed off by impact plates 5.1 fastened to the body 3. A piston 2 travels pressure-tight in each of these bores 4. A variable end space 9 always lies between each face of the piston 2 and the associated impact plate 5. The pistons 2 serve alternately for producing shocks and for controlling the striking element 1. The pistons 2 have indents 8, in the form of milled grooves or recesses, at predetermined locations in their length, so that a free space between the piston 2 and the wall of the associated bore 4 is produced at these locations.

A pressure line 10 and a pressure supply line 12, each leading to an end space 9, open at predetermined locations of the wall of the bores 4*i*. Each of the indents 8 of the piston 2 connects a pressure line 10 with a pressure supply line 12 at predetermined locations, so that the associated end space 9 may be placed under the pressure of the pressure supply line 12. An end space 9.*i* at a piston 2 is always vented, the other end space 9.*k* being placed under high pressure.

A piston 2.*i* is displaced by high pressure in the associated one end space 9.*k* toward the vented other end space 9.*i* until the face of the piston 2.*i,* at the vented end space 9.*i,* strikes the impact plate 5.*i*. For this purpose, the faces of the piston 2 are smaller than their remaining cross section, so that an open end space 9 is always present. Owing to striking of the one piston 2.*i* on the associated impact plate 5.*i,* the indents 8 of the said piston 2.*i* are brought into those positions in which they connect a pressure line 10.*i* with a pressure supply line 12.*i*. Thus the associated end space 9.1 of the other piston 2.1 may be placed under the pressure of the pressure supply line 12.*i*. If, for example, at the other piston 2.1 the first end space 9.*m* is placed under high pressure and the second end space 9.1 is vented, the other piston 2.1 now is displaced toward the now vented end space 9.1. Thus a motion cycle is produced which continues as long as high pressure is applied to the striking element.

A striking element 1 having a plurality of pistons 2.*i* may be designed according to the same basic principle as one having two pistons 2. In that case two pistons 2.1 and 2.2 may be used for control and the remaining pistons 2.*i* and 2.*k* may be run half each parallel respectively to the control pistons 2.1 and 2.2. There the number of indents 8 on the pistons remains the same. The number of pressure lines 10 increases proportionally to the number of pistons 2. With such an arrangement, the same number of shocks is executed per unit of time as in the case of the striking element 1 with two pistons 2.1 and 2.2, shock energy increasing proportionally to the number of pistons 2. This arrangement is recommended when it is desired to transmit shocks evenly to a fairly large area.

Figure 7A:
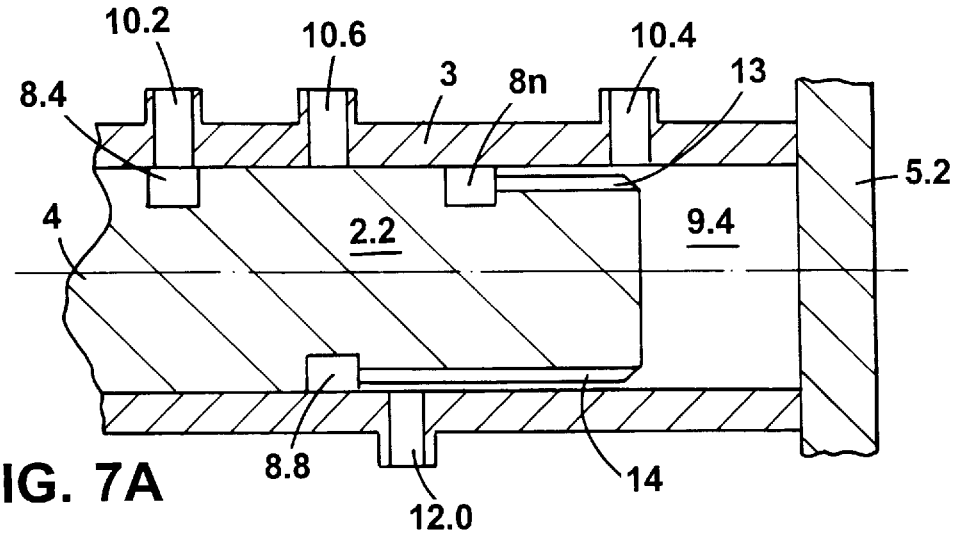
FIG. 7 shows part of a striking element wherein the loosening shock proceeds with little energy
Figure 7B:
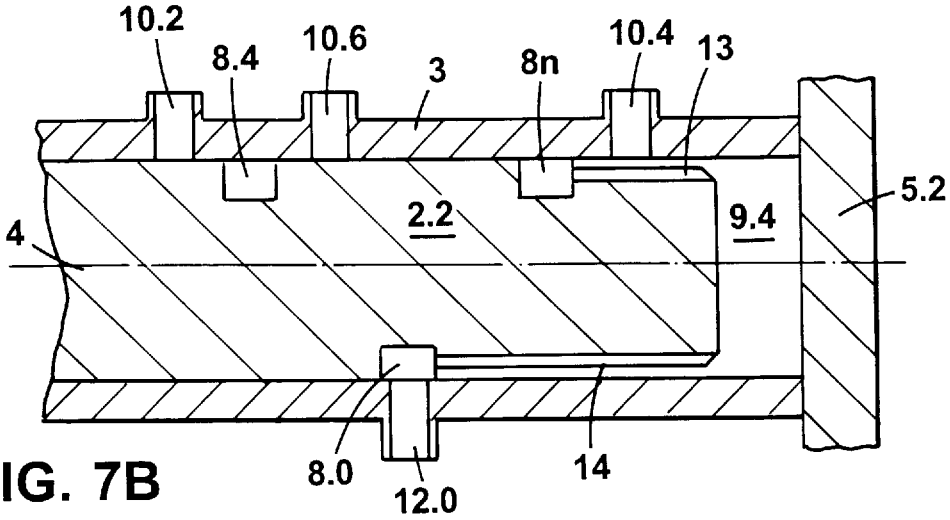
Figure 7C:
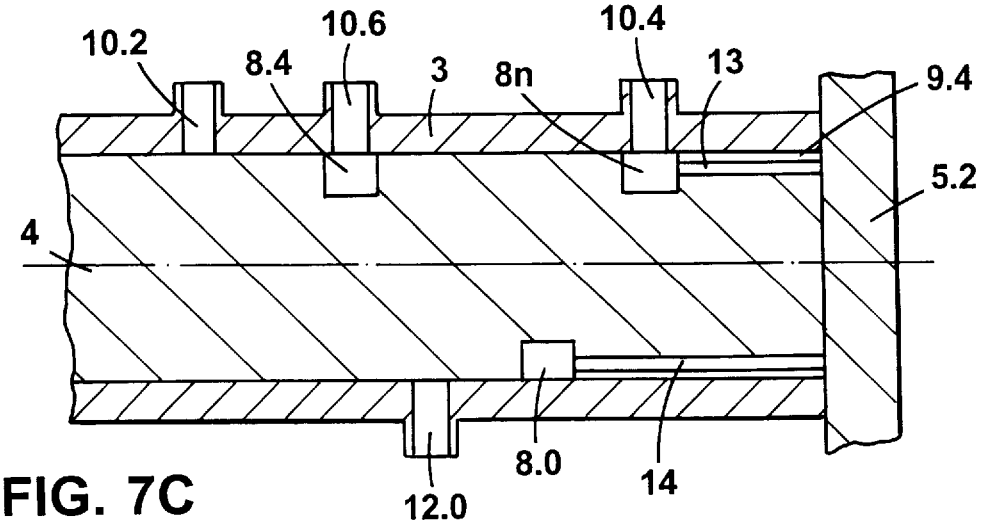

In FIG. 7, which consists of FIGS. 7A to 7C, part of a striking element 1 is shown wherein the energy of the "loosening" shock, acting against the direction of the tool, is reducible. This is desirable in many cases. The end of a bore 4 in the body 3, the piston 2 belonging to the bore 4, the impact plate 5 and the end space 9 are shown therein. The impact plate 5 lies opposite that one which is connected to the tool. In FIG. 7 there is shown, laterally inverted, a situation analogous to that on the right-hand side of FIG. 5A, piston 2.2, and therefore the reference numerals used there are adopted.

In FIG. 7A the piston 2.2 is situated in an end position at the greatest distance from the plate 5.2. In this embodiment, rather than annular indents, short milled grooves, running axially, are used as indents 8. The milled groove 8.4, through the pressure line 10.2, supplies the other piston 2.1, not shown, with pressure medium, the end space 9.4 being vented through the pressure line 10.4.

Now, upon motion of the second piston 2.2 toward the second plate 5.2, high pressure is to be applied to the fourth end space 9.4 for a short time toward the end of the motion, which slows down the piston 2.2. After that the end space 9.4 is vented anew, whereupon the piston 2.2 strikes the plate 5.2 only at slow speed.

For this purpose the fourth—starting from the recess 8.2, not shown, on the piston 2.1—pressure line 10.4, for example, is introduced, distinctly before the right-hand end of the bore 4.2, into the latter. An additional nth milled groove 8.*n,* which through a short line 13 opens into the end space 9.4, is situated in the head of the piston, shortly before its right-hand end.

This results in the formation of a rib on the piston 2.2 which, in FIG. 7B, toward the end of the motion—this is indicated by an arrow—of the piston 2.2 closes off the pressure line 10.4 and thus prevents venting of the end space 9.4 for a short time. During the same time, an additional 0th milled groove 8.*o* runs further right on the piston 2.2 past an additional pressure supply line 12.*o,* carrying high pressure, which is connected by the milled groove 8.*o* through a long line 14 with the end space 9.4. This places the end space 9.4 under high pressure during the time of passage and slows down the piston 2.2.

As shown in FIG. 7C, shortly before the piston 2.2 reaches the impact plate 5.2, the nth milled groove 8.n arrives in the region of the pressure line 10.4 and again vents the end space 9.4 through the short line 13. The 0th milled groove 8.*o* of the piston 2.2 has then traveled past the additional pressure supply line 12.*o* and the piston 2.2 closes the said supply line again, so that high pressure does not reach the end space 9.4 through the long line 14. The end space 9.4 is vented anew, the piston 2.2 is again speeded up a little and strikes the impact plate 5.2 with very little energy. Thus the energy of the "loosening" shock is significantly reduced.

If the high pressure at the additional pressure supply 12.*o* is taken away, the piston is not slowed down and executes "loosening" shocks with full energy. It is recommended that the pressure at the additional pressure supply 12.*o* be made adjustable to the desired retardation of the piston 2.2 by a reducing valve.

If it is desired to make the shocks adjustable as "hard shocks" and "loosening shocks" at both ends of the striking element 1, the piston 2 and the body 3 must be provided with the means just described at both ends.

Figure 9:
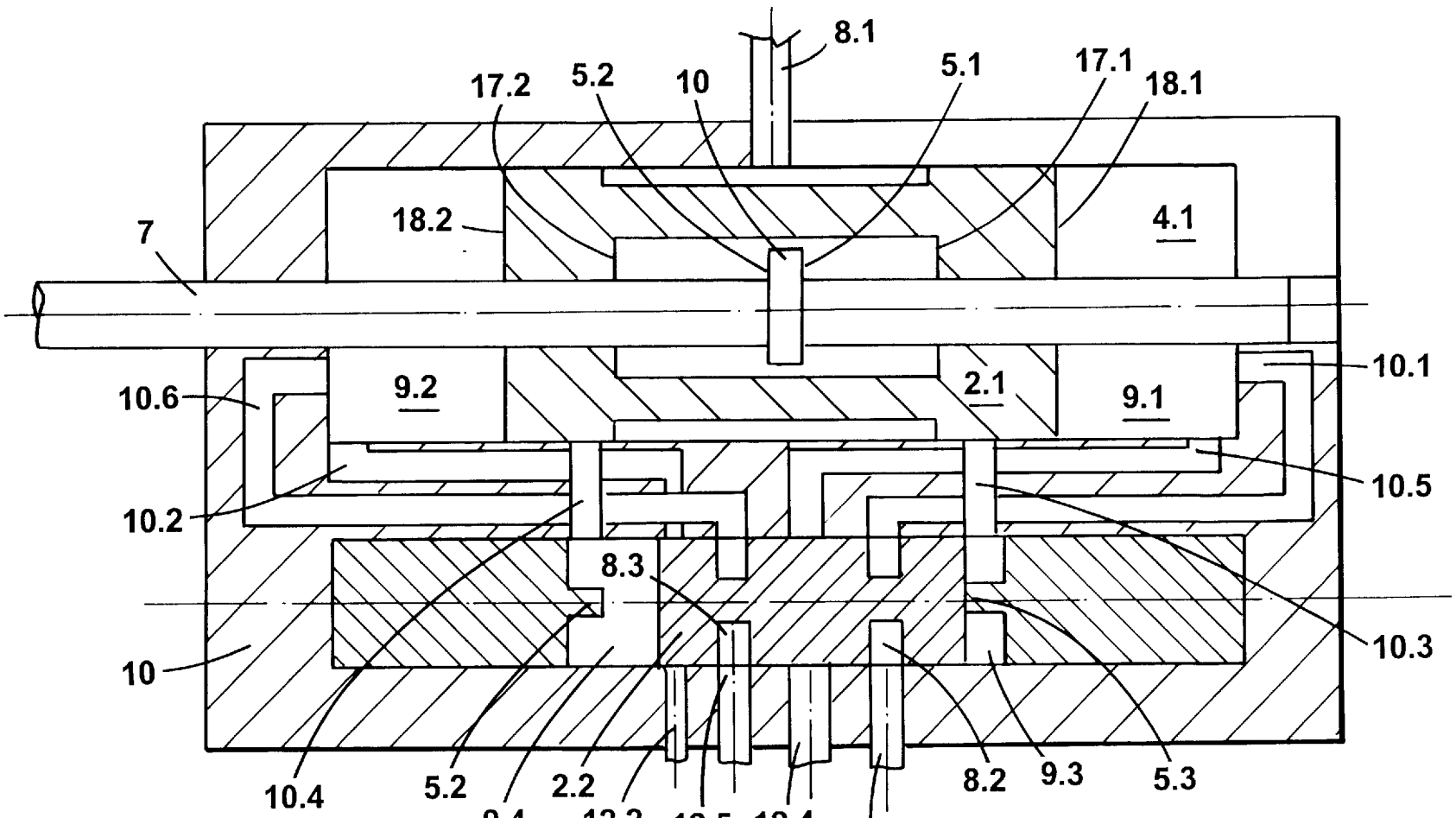
FIG. 9 shows a second example of a striking element.

A second example of the arrangement of a striking element 1 according to the invention is shown in FIG. 9. In it a shank 7, to which a tool is attached, passes axially through the entire first bore 4.1. A first piston 2.1 extends as an annular piston axial to the shank 7 and seals against the shank 7, for example by lubrication, over its entire length against the inner wall of the bore 4.1, as well as at its two face plates 17.1 and 17.2. The first piston 2.1 may thus move freely in its interior axially toward the shank 7 and an annular bead 16 mounted on the shank 7. The faces of the two stops 5.1 and 5.2 lie on the two sides of the annular bead 16. The inner sides of the face plates 17.1 and 17.2 of the piston 2.1 can strike these stops 5.1 and 5.2. The first piston 2.1 has a single first indent 8.1, which is designed as a wide recess over the surface of its central part. At the two ends of the first piston 2.1, first and second end spaces 9.1 and 9.2, closed off from the outside, are situated in the first bore 4.1. These end spaces 9.1 and 9.2 do not disappear even when the first piston 2.1 assumes one of its end positions.

A piston 2, shaped as in the first example, is situated in a second bore 4.2. It has two indents 8.2 and 8.3 and travels alternately toward the stops 5.3 and 5.4 in the second bore 4.2. On the inner side of the stops 5.3 and 5.4, there is in each instance an end space 9.3 and 9.4. These do not disappear even when the second piston 2.2 is at one of the stops 5.3 or 5.4.

The first pressure supply line 12.1 carries the pressure medium to the recess 8.2 on the second piston 2.2 when the latter is at the right-hand stop 5.3 and conducts it through the first pressure line 10.1 on to the first end space 9.1 at the first piston 2.1. The second pressure supply line 12.2 carries the pressure medium to the third recess 8.3 when the second piston 2.2 is at the left-hand stop 5.4 in the second bore 2.2 and conducts it through the second pressure line 10.2 on to the first end space 9.1 at the first piston 2.1. If the second piston 2.2 is in another position, these lines are cut off.

The third pressure line 10.3 connects the third end space 9.3 at the second piston 2.2 with the first end space 9.1 at the first piston 2.1 when the edge 18.1 at the right-hand face plate 17.1 of the first piston 2.1 is situated on the left of the opening of the third pressure line 10.3 in the first bore 4.1. It connects the third end space 9.3 with the first recess 8.1 on the first piston 2.1 and then conducts the pressure medium away through the third pressure supply line 12.3. In all other positions of the pistons 2.1 and 2.2, these lines are cut off.

The pressure line 10.4 connects the end space 9.4 at the second piston 2.2 with the end space 9.2 at the first piston 2.1 when the edge 18.2 at the right-hand face plate 17.2 of the first piston 2.1 is situated on the right of the opening of the pressure line 10.4 in the bore 4.1. It connects the end space 9.4 with the recess 8.1 on the first piston 2.1 and then conducts the pressure medium away through the pressure supply line 12.3. In all other positions of the pistons 2.1 and 2.2, these lines are cut off.

The fifth pressure line 10.5 connects the first end space 9.1 of the first piston 2.1, through the second recess 8.2 of the second piston 2.2, with the fourth pressure supply line 12.4 when the second piston 2.2 is in its left-hand end position. The sixth pressure line 10.6 connects the end space 9.2 of the second piston 2.1, through the third recess 8.3, with the fifth pressure supply line 12.5 when the second piston 2.2 is in its right-hand end position. In all other positions of the piston 2.2, these lines are cut off.

We shall consider the method of operation of the striking element 1 according to the second example. Both pistons 2.1 and 2.2 initially are situated on the right-hand side, and all end spaces are pressure-free. The pressure medium is connected to the pressure supply lines 12.1 and 12.2, the lines 12.3, 12.4 and 12.5 serving to carry the pressure away.

The pressure medium is carried, through the first pressure supply line 12.1, through the second recess 8.2 in the second piston 2.2 and through the first pressure line 10.1 to the right-hand first end space 9.1 of the first piston 2.1, builds up pressure there and moves the first piston 2.1 toward the left. The pressure medium in the second end space 9.2 is carried off through the sixth pressure line 10.6, the third recess 8.3 and the fifth pressure supply line 12.5. The second pressure line 12.2 is cut off by the second piston 2.2 as long as the latter is in its right-hand position. Shortly before the inside of the right-hand face plate 17.1 of the first piston 2.1 strikes the right-hand stop 5.1 located on the annular bead 16, the right-hand edge 18.1 of the first piston 2.1 travels to the opening of the third pressure line 10.3 and opens the said line, and the third end space 9.3 of the second piston 2.2 is thereby placed under pressure and pushes the second piston 2.2 toward the left. Starting at the same time, the first recess 8.1 on the first piston 2.1 begins to travel over the fourth pressure line 10.4 and opens the latter, so that the pressure building up in the fourth end space 9.4 of the piston 2.2 due to this displacement is relieved through the third pressure supply line 12.3. Meanwhile, the inside of the right-hand face plate 17.1 of the first piston 2.1 strikes the stop 5.1 on the annular bead 16 and the shock is transmitted to the tool through the shank 7.

After the shock both pistons 2.1 and 2.2 are in their left-hand end position. Now the pressure medium is carried through the second pressure supply line 12.2, through the second recess 8.2 in the second piston 2.2 through the second pressure line 10.2 to the left-hand second end space 9.2 of the first piston 2.1, builds up pressure there and moves the first piston 2.1 toward the right. The pressure medium in the first end space 9.1 is carried away through the fifth pressure line 10.5 through the second recess 8.2 and the fourth pressure supply line 12.4. The first pressure supply line 12.1 is cut off by the second piston 2.2 as long as the latter is in its left-hand position. Shortly before the inside of the left-hand face plate 17.2 of the first piston 2.1 strikes the left-hand second stop 5.2 on the annular bead 16, the edge 18.2 of the first piston 2.1 travels over the opening of the fourth pressure line 10.4 and opens the latter, and the fourth end space 9.4 of the second piston 2.2 is thereby placed under pressure and pushes the second piston 2.2 toward the right. Starting at the same time, the first recess 8.1 on the first piston 2.1 begins to travel over the third pressure line 10.3 and opens the latter, so that the pressure building up in the third end space 9.3 of the piston 2.2 due to this displacement is relieved through the third pressure supply line 12.3. Meanwhile, the inside of the left-hand face plate 17.2 of the first piston 2.1 strikes the left-hand second stop 5.2 on the annular bead 16 and the shock is transmitted to the tool by the shank 7.

If the shocks of the second piston are likewise to be transmitted to the tool, a suitable rod must transmit these shocks from the stops 5.3 and/or 5.4 to the shank 7 or the tool. With such devices double shocks, in the form of a strong shock and—depending upon the sizing of the dimensions of the impact tool—a weaker shock, may be produced shortly before or thereafter in simple fashion.

The same means as described in the first example may be used for reducing the energy of shocks in one direction, as well as for adjusting shock energy.

Either compressed air, another gas or a liquid may be used as pressure medium for the striking element 1 according to the invention.

It is advantageous to make the piston of heavy material, for example heavy metal. Advantageously, the impact plates 5 must be constructed of tough material with high strength and the stops heat-treated. Light metal or high-strength synthetic material may alternatively be used for the other parts.

If it is desired to use the striking element 1 in the drive of rotary tools, it should be designed with its axis as much as possible in the axis of the rotary tool. The supply of high pressure to the striking element 1 must take place axially through a rotary pressure coupling. Drive of the rotary tool may be effected from the side, while structural elements, for example, gear wheels which are not sensitive to axial shocks, must be used at the coupling point between the tool carrier and the gear.

The striking element 1 according to the invention has a plurality of pistons 2 which, for comparable dimensions, have greater masses than striking elements according to the prior art. Since the pressure in the end spaces 9 is not built up or relieved during motion, but is immediately varied at the end of each phase, the striking sequence is more frequent, which in the first example is further supported in that at least two working shocks take place during a complete working cycle. It thus delivers greater shock energy per unit of time.

The striking element is used in surgery, but also in the manufacture of apparatus.

What is claimed is:

1. A striking element for producing mechanical shocks for transmission to a tool comprising:

a body having a first bore and a second bore;

stops fastened to the body and located at each end of said bores;

a first piston in said first bore and a second piston in said second bore, each of said pistons having faces and being mounted to travel pressure-tight in its bore, the length of each of said pistons being less than the distance between stops located at the end of the associated bore, leaving an end space remaining between the faces of each of said pistons and the stops; and a shank supporting said tool and passing axially through the first bore;

the striking element being actuable by a medium supplied under pressure to cause the pistons to deliver the mechanical shocks; wherein said first piston is annular and radially surrounds said shank;

wherein said shank is provided with a pair of shank stops located within said piston and said first piston strikes one or the other of said shank stops, depending upon the direction of said first piston's longitudinal motion within said first bore.

2. Striking element according to claim 1 wherein each of said pistons has recesses at predetermined locations with respect to said faces of said pistons, forming a free space between the piston and the associated bore at the predetermined locations.

3. Striking element according to claim 2, further comprising pressure lines connecting said first bore with said second bore, wherein pressure lines open into each of said bores at predetermined locations.

4. Striking element according to claim 3, wherein said recesses of one of said pistons and that piston comprise a valve connecting one of said pressure lines with a pressure supply line so that one of the end spaces associated with another of said pistons may be placed under pressure.

5. Striking element according to claim 4, wherein, in its operation, one end space at each piston always vents and the other end space is placed under high pressure.

6. Striking element according to claim 5, wherein one of said pistons is displaced toward the vented end space by high pressure in said other end space until that piston strikes the stop in the direction of said vented end space.

7. Striking element according to claim 6, wherein, when one of said pistons strikes one of its associated stops, said recesses of that piston are located so that they connect each of two of said pressure line to the other of said pistons, so that in the bore containing the latter piston the previously vented end space is placed under high pressure and the end space previously placed under high pressure is vented.

8. Striking element according to claim 7, wherein the stops are impact plates which in each instance totally close off one end of the bore.

9. Striking element according to claim 8, wherein one of these impact plates supports the tool by means of a shank formed as a nipple.

10. Striking element according to claim 2 wherein the said first piston passes through the entire body of the striking element.

11. Striking element according to claim 10, wherein said first piston is controlled by said second piston which acts on said stops in said second bore which are in the form of impact plates.

12. Striking element according to claim 11, wherein a rod is present, which additionally transmits the shocks of said second piston to the tool.

13. Striking element according to claim 10 wherein the energy of the shock acting in a given direction is reducible in that, upon motion of one of said pistons toward one of said impact plates, high pressure may be applied to the associated end space for a short time toward the end of said motion, which slows down that piston, and then that end space is vented anew, whereupon that piston strikes that impact plate only at slow speed.

14. Striking element according to claim 13, wherein one of said pressure lines which vents one of said end spaces is introduced distinctly before the end of the bore, and further comprising an additional recess in that piston located a short distance from the face of that piston and connected through a short line into that end space, a further recess is located in that piston at a greater distance from the face of that piston and connected through a long line into that end space, and an additional pressure supply line opening into the bore containing that piston at a greater distance from the end of the bore than the end of said pressure line.

15. Striking element according to claim 14, wherein, during motion of that piston in the direction toward that impact plate, the opening of said pressure line into that bore is blocked by the surface of that piston between the additional recess and that face of that piston, so that that end space cannot be vented, and at the same time the further recess comes to lie over the opening into that bore of the additional pressure supply line so that that end space is placed under high pressure through the long line and thus the movement of that piston toward that impact plate is slowed.

16. Striking element according claim 15, wherein, shortly before the shock of the piston against the impact plate, the additional recess of that piston comes to lie under said pressure line, but the further recess is again blocked by that piston, so that that end space is again vented and thus the piston strikes the impact plate at a reduced speed.

17. Striking element according to claim 16, wherein that piston is not slowed down when the high pressure on the pressure supply line is relieved.

18. Striking element according to claim 18, further comprising a reducing valve in said additional pressure supply line for adjusting the retardation of that piston.

19. Striking element according to claim 1 wherein compressed gas is used as the pressure medium.

20. Striking element according to claim 1 wherein a liquid is used as the pressure medium.

21. Striking element according to claim 1, wherein each of said faces of said pistons is smaller in area than the cross section of the piston, so that even after the piston strikes the stop an end space always remains.

22. Striking element according to claim 1 wherein transmission of the shock by one of said pistons to one of said stops is mediated by a striking pin.

23. Striking element according to claim 1 wherein the piston is made of heavy elastic metal.

24. Striking element according to claim 23 wherein the stops comprise a hardened metal surface.

25. Striking element according to claim 1 wherein, except for said pistons and said stops, the striking element is made of light solid material.

26. Striking element according to claim 1 further comprising an annular bead surrounding and attached to said shank, located within said first piston, wherein said shank stops are located on said annular bead.

* * * * *